US007597458B2

(12) United States Patent
Johnson et al.

(10) Patent No.: US 7,597,458 B2
(45) Date of Patent: Oct. 6, 2009

(54) APPARATUS, SYSTEM, AND METHOD FOR A CERAMIC METAL HALIDE RETROFIT KIT FOR A FRAMING PROJECTOR

(75) Inventors: Glenn M. Johnson, Salt Lake City, UT (US); Ed Heater, Eden, UT (US); Troy Seaton, West Jordan, UT (US)

(73) Assignee: Mountain Springs Holdings, LLC, Salt Lake City, UT (US)

( * ) Notice: Subject to any disclaimer, the term of this patent is extended or adjusted under 35 U.S.C. 154(b) by 89 days.

(21) Appl. No.: 11/626,263

(22) Filed: Jan. 23, 2007

(65) Prior Publication Data

US 2008/0175000 A1 Jul. 24, 2008

(51) Int. Cl.
*F21V 21/00* (2006.01)

(52) U.S. Cl. ..... 362/265; 362/221; 362/263; 362/364; 362/365; 362/640; 362/652

(58) Field of Classification Search ..... 362/265, 362/267, 277, 321, 351, 362, 364–365, 382, 362/418, 221, 263, 652
See application file for complete search history.

(56) References Cited

U.S. PATENT DOCUMENTS 4,636,925 A 1/1987 Kristofek ..... 362/277
4,701,833 A * 10/1987 Bornhorst ..... 362/294
5,295,056 A 3/1994 Peck ..... 362/267
5,404,283 A 4/1995 Yantz et al. ..... 362/267
6,283,600 B1 9/2001 Levasseur ..... 353/119
6,414,436 B1 7/2002 Eastlund et al. ..... 313/634
6,483,237 B2 11/2002 Eastlund et al. ..... 313/570
6,661,174 B2 12/2003 Eastlund et al. ..... 313/634
7,049,768 B1 * 5/2006 Zhu et al. ..... 315/307

OTHER PUBLICATIONS

Altman Architectural, "ODEC Outdoor Framing Projector", www.altmanlighting.com.
Wendelighting, "Recessed Optical Projector Model: 2396", www.wendelighting.com.

* cited by examiner

*Primary Examiner*—Sandra L O'Shea
*Assistant Examiner*—Meghan K Dunwiddie
(74) *Attorney, Agent, or Firm*—Kunzler & McKenzie

(57) ABSTRACT

An apparatus, system, and method are disclosed for replacing an incandescent lamp with a ceramic metal halide ("CMH") lamp in a framing projector. A CMH base is connected to a framing projector body at a connection for an incandescent lamp base for an incandescent lamp. The CMH base positions a CMH lamp relative to a focal point of a reflector within the framing projector body. The CMH lamp is plugged into a CMH socket on the CMH base and the framing projector body includes an opening and connection for an incandescent base holding an incandescent lamp relative to the focal point. A CMH ballast for the CMH lamp is included and is connected to the CMH base and to an electrical connection of the incandescent lamp base.

20 Claims, 4 Drawing Sheets

APPARATUS, SYSTEM, AND METHOD FOR A CERAMIC METAL HALIDE RETROFIT KIT FOR A FRAMING PROJECTOR

BACKGROUND OF THE INVENTION

1. Field of the Invention

This invention relates to framing projectors and more particularly relates to a Ceramic Metal Halide ("CMH") retrofit kit for an incandescent framing projector.

2. Description of the Related Art

A framing projector is a precision light fixture that directs light onto an object without spilling light onto unwanted areas beyond the object. For example, a framing projector may be used to precisely project light onto a painting without projecting light onto the painting's matting and frame. A framing projector may be used to highlight paintings, photographs, sculptures, etc. Framing projectors may be used indoors or outdoors. Outdoor framing projectors may be used to project light onto certain portions of a building or onto a sculpture.

Traditionally, framing projectors have used incandescent lamps as a light source. Outdoor fixtures have more recently used high intensity discharge ("HID") lamps such as metal halide ("MH") and high pressure sodium ("HPS"). However, until recently HID lamps have been inappropriate for indoor use. Traditional HPS and MH lamps are relatively large and require a long startup period before stabilizing at a uniform brightness and color. HPS lamps produce a yellow light with a low color rendering index ("CRI") that is typically inappropriate for use with artwork and is typically only used to highlight building structures of certain warm colors. MH lamps traditionally also have a low CRI and are subject to color shifting over time.

Indoor framing projectors frequently use incandescent lamps of some type. Typically quartz and halogen lamps are used in various forms. Many framing projectors use a lamp with a bulb in a T4 configuration. Incandescent lamps are typically used in indoor framing projectors. Incandescent lamps have a benefit of instantaneously providing light when powered and providing a fairly stable image and color. However, incandescent lamps typically have a short lamp life and produce tremendous heat at high wattage. A short lamp life requires constant attention by maintenance personnel to replace lamps. Heat must be dissipated by a light fixture without causing a fire. Infrared heat emitted from an incandescent lamp can also be a problem because of its effect on art work and framing projector attachments. For example, emitted infrared light may require a filter.

Incandescent lamps, such as a quartz lamp in a T4 configuration, also typically have a long filament that affects focusing. A point source of light is an ideal source because a parabolic reflector can be shaped with a focal point positioned with respect to the point source. The focal point of the reflector is typically positioned beyond the lamp, other wise the lamp would block or shadow the reflected light. Incandescent lamps with a long filament used with a parabolic reflector cannot be focused as crisply as other lamps that are more like a point source and may produce an undersized projected image. A long filament may also sag as it is heated which may affect focusing and lamp life.

Halogen lamps in an MR16 or similar configuration may also be used in a framing projector. MR16 halogen lamps have a longer lamp life, but are limited because they have an integral reflector. An integral reflector reduces design flexibility by limiting how light is reflected through framing projector lenses. MR16 lamps also produce a lot of heat, but not as much as a quartz lamp.

A sectional view of a framing projector with an incandescent lamp is depicted in FIG. 1. FIG. 1 includes a framing projector 100 with a framing projector body 102 that includes an incandescent lamp 104 in a quartz T4 configuration with a long filament 106. The quartz lamp 104 fits in a socket 108 that is part of an incandescent lamp base 110. The incandescent lamp base 110 is attached to the framing projector body 102 using fasteners 112, such as spring loaded bolts, screws, etc. The fasteners 112 are typically arranged in a specific pattern to allow the incandescent lamp base 110 to mate to the framing projector body 102.

The framing projector body 102 typically includes a parabolic reflector 114 configured with a focal point beyond the center of the filament 106 of the incandescent lamp 104. The center of the incandescent lamp 104, which is positioned with respect to the focal point of the parabolic reflector 114, is depicted in the framing projector 100 as the intersection of a horizontal axis 116 and a vertical axis 118. As depicted, a large portion of the filament 106 of the incandescent lamp 104 is above and below the horizontal axis 116, which decreases the ability to focus projected light. The framing projector body 102 typically includes lenses 120 that condense and focus light. The framing projector body 102 also includes a front cone assembly 122 and a focal tube assembly 125 that extends out of a framing projector housing and directs projected light through an objective lens 123 which determines the overall size of the light beam emitted to cover the intended target.

Framing projectors 100 with incandescent lamps 104 typically include a metal conduit 124 connected to the incandescent lamp base 110 that houses wiring (not shown) connected to the incandescent lamp socket 108. The metal conduit 124 is typically required due to the large amount of heat produced by the incandescent lamp 104. Non-metallic covering for wiring typically cannot be used with framing projectors 100 with incandescent lamps 104 because the framing projector body 102 and incandescent lamp base 110 reach temperatures exceeding temperature ratings of non-metallic wire coverings. The metal conduit 124 typically includes an elbow connector 126 and flexible metallic conduit 128. The elbow connector 126 is a hindrance because it limits available positioning of the framing projector 100 within a framing projector housing.

Indoor framing projectors 100 with incandescent lamps 104 have been around for many years so thousands of existing framing projectors 100 with incandescent lamps 104 are installed and functioning. New framing projectors 100 with incandescent lamps 104 are currently being sold and installed. Installation of a framing projector 100 with an incandescent lamp 104 is problematic because of the high amount of heat and energy produced by the incandescent lamp 104. Framing projector housings that have framing projectors 100 with incandescent lamps 104 typically require ventilation holes. Ventilation holes in framing projector housings prevent achieving an insulation contact ("IC") rating or an airtight rating.

A light fixture with an IC rating is beneficial because insulation can be placed against and over the light fixture. As many as 33 states currently require a recessed light fixture to have an airtight rating. A light fixture with an airtight rating is energy efficient because conditioned air cannot escape in any significant amount through the light fixture.

SUMMARY OF THE INVENTION

From the foregoing discussion, it should be apparent that a need exists for an apparatus, system, and method for replacing an incandescent lamp assembly in a framing projector with a ceramic metal halide ("CMH") assembly with a CMH lamp. Beneficially, such an apparatus, system, and method would allow replacement of an incandescent lamp in an existing framing projector with a CMH lamp. A CMH lamp has a much longer lamp life compared with an incandescent lamp, produces about 60% less heat and 40% less energy, and is more of a point source than an incandescent lamp.

The present invention has been developed in response to the present state of the art, and in particular, in response to the problems and needs in the art that have not yet been fully solved by currently available framing projectors. Accordingly, the present invention has been developed to provide an apparatus, system, and method for replacing an incandescent lamp with a CMH lamp in a framing projector that overcome many or all of the above-discussed shortcomings in the art.

The apparatus includes a CMH base connected to a framing projector body at a connection for an incandescent lamp base for an incandescent lamp. The CMH base positioning a CMH lamp relative to a focal point of a reflector within the framing projector body. The CMH lamp is plugged into a CMH socket on the CMH base. The framing projector body includes an opening and connection for an incandescent base holding an incandescent lamp relative to the focal point. The apparatus includes a CMH ballast for the CMH lamp and the CMH ballast is connected to the CMH socket and to an electrical connection of the incandescent lamp base.

The apparatus, in one embodiment, is configured to include a framing projector housing where the framing projector body and CMH ballast are mounted within the framing projector housing. In another embodiment, the CMH ballast is mounted in the framing projector housing in a position that does not interfere with possible positions of the framing projector body and an attached positioning mechanism. In another embodiment, the CMH base is attached to the framing projector body with adjustable fasteners for positioning the CMH lamp relative to the focal point. In another embodiment, the CMH base positions the center of an arc tube in the CMH lamp at location designed for mounting the center of a filament of the incandescent lamp. In yet another embodiment, the CMH base includes light shielding to prevent light leakage allowed by the incandescent base.

In one embodiment, wiring connecting the CMH ballast to the CMH base includes a non-metallic, thermo protective covering over insulation of the wiring. In another embodiment, wiring connecting the CMH ballast to the CMH base includes a connection through a side of the CMH base. The CMH lamp plugs into the top of the CMH socket mounted on top of the CMH base. In another embodiment, the CMH ballast is a dimmable ballast. In yet another embodiment, the electrical connection of the framing projector housing is an electrical outlet.

A system of the present invention is also presented to replace an incandescent lamp with a CMH lamp in a framing projector. The system may be embodied by a framing projector housing that includes a framing projector body and an electrical connection. The framing projector body includes a connection for an incandescent base configured to hold an incandescent lamp. The system includes a CMH lamp and a CMH base with a socket holding the CMH lamp and connected to the framing projector body at the connection for the incandescent lamp base. The CMH base is configured to position the CMH lamp plugged into the socket of the CMH base at a location designed for mounting the center of a filament of the incandescent lamp relative to a focal point of a reflector within the framing projector housing. The system includes a CMH ballast mounted in the framing projector housing and connected to the CMH base and to the electrical connection.

In one embodiment, the framing projector housing is located in a ceiling or a wall. In another embodiment, the framing projector housing containing the CMH lamp, the CMH base, and the CMH ballast comprise a fixture with an insulation contact ("IC") rating and/or an air tight rating. In another embodiment, the system includes a ballast cover mountable over the CMH ballast.

A method of the present invention is also presented for replacing an incandescent lamp with a CMH lamp in a framing projector. The method in the disclosed embodiments substantially includes the steps necessary to carry out the functions presented above with respect to the operation of the described apparatus and system. In one embodiment, the method includes disconnecting power to an incandescent lamp of a framing projector body. The incandescent lamp is plugged into an incandescent lamp base, the incandescent base and lamp are mounted to the framing projector body, and the framing projector body is positioned within a framing projector housing. The method includes removing the incandescent lamp base from the framing projector body and connecting and positioning a CMH base to the framing projector body. A CMH lamp is plugged into a socket mounted on the CMH base. The method includes mounting a CMH ballast to the framing projector housing. The CMH ballast is wired to the CMH base. The method includes connecting power to the CMH ballast to a power source that was disconnected from the incandescent lamp.

In one embodiment, positioning the CMH base includes positioning the CMH lamp plugged into the socket of the CMH base at a location designed for mounting the center of a filament of the incandescent lamp relative to a focal point of a reflector within the framing projector housing. In another embodiment, positioning the CMH base includes positioning the CMH base so that approximately the center of a lighting illumination point within the CMH lamp aligns with a location designed for mounting the center of a filament of the incandescent lamp relative to the focal point. In yet another embodiment, disconnecting power to the incandescent lamp includes unplugging a power cord from an electrical outlet mounted at the framing projector housing, and connecting power to the CMH ballast includes plugging a cord extending from the CMH ballast into the electrical outlet.

In one embodiment, the method includes realigning and refocusing the framing projector on an intended target in response to power being applied to the CMH lamp and the CMH lamp warming to a nominal operating temperature. In another embodiment, the method includes sealing holes in the framing projector housing.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided for a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Figure 1:
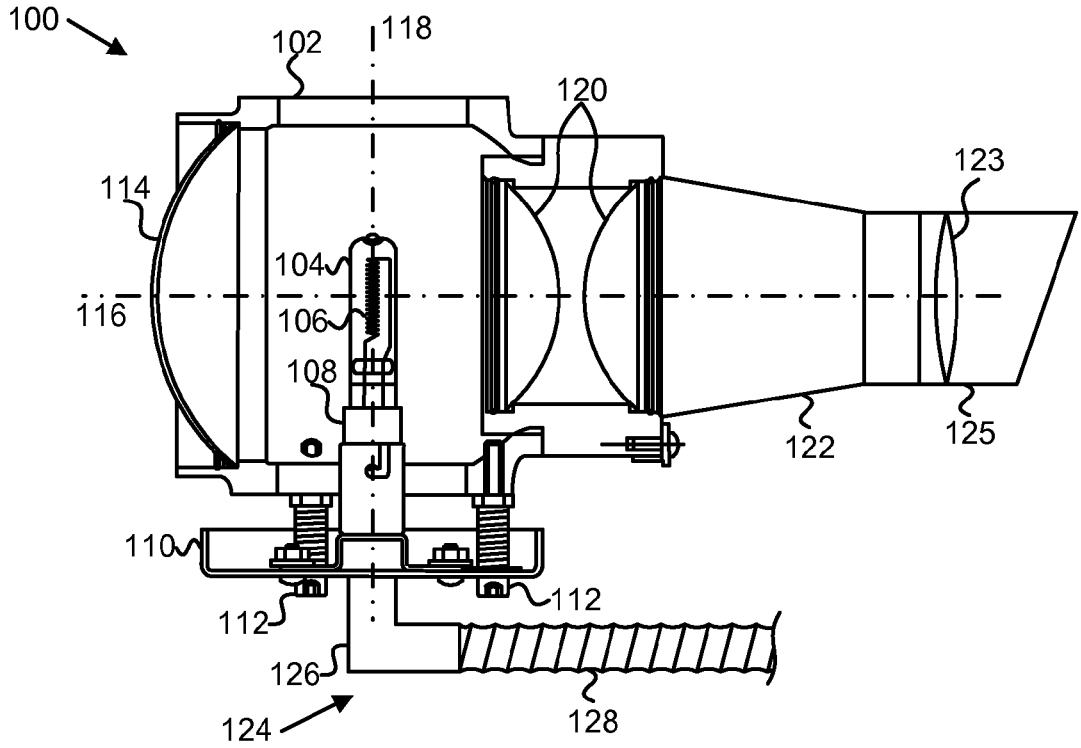
FIG. 1 (Prior Art)
FIG. 1 is a prior art diagram illustrating one embodiment of a framing projector with an incandescent lamp.
Figure 2:
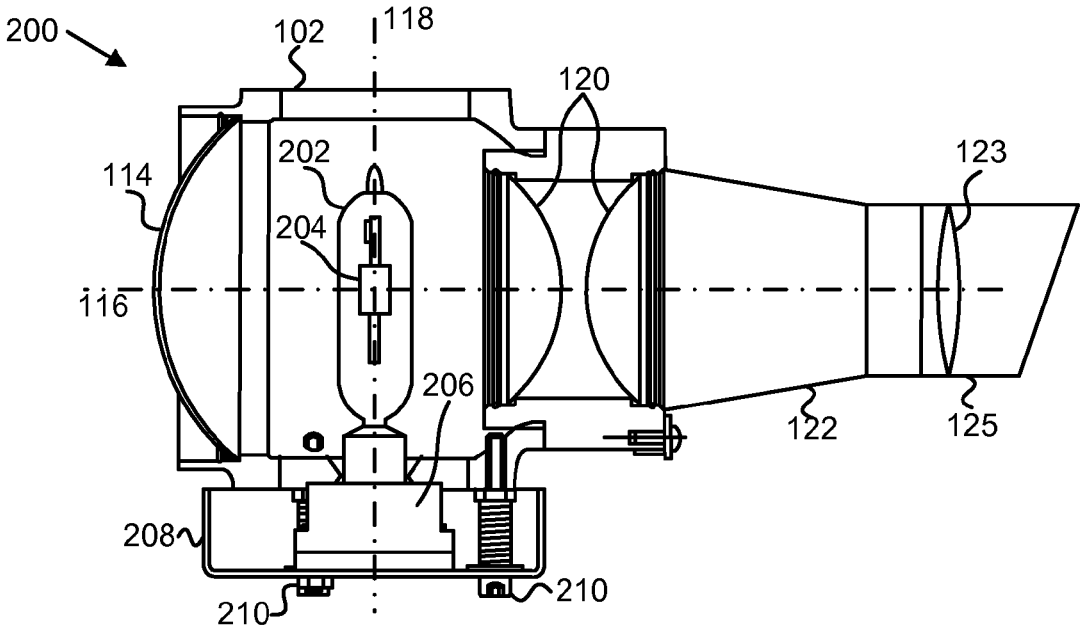
FIG. 2 is a schematic block diagram illustrating one embodiment of a framing projector with a portion of an apparatus for a CMH retrofit kit in accordance with the present invention.

FIG. 2 depicts one embodiment of a framing projector 200 with a portion of an apparatus for a CMH retrofit kit in accordance with the present invention. The framing projector 200 includes a framing projector body 102 with a parabolic reflector 114, lenses 120, front cone assembly 122, focal tube assembly 125, and objective lens 123, which are substantially similar to the framing projector 100 depicted in FIG. 1. The parabolic reflector 114 has the same focal point as the incandescent framing projector 100 of FIG. 1. An intersection of the horizontal and vertical axes 116, 118 is depicted, which is the location where the center of a filament 106 of an incandescent lamp 104 is designed to be located, which is in relation to the focal point of the parabolic reflector 114. The framing projector 200 includes a ceramic metal halide ("CMH") lamp 202 with an arc tube 204, a CMH socket 206, a CMH base 208, and fasteners 210, which are part of an apparatus for a CMH retrofit kit and are described below.

The framing projector 200 includes a CMH lamp 202. The CMH lamp 202 is plugged into a CMH socket 206 configured to receive the CMH lamp 202 and make electrical contact with terminals on the CMH lamp 202. The CMH lamp 202 is located such that an arc tube 204 that is the source of light emitted from the CMH lamp 202 is centered at the intersection of the horizontal and vertical axes 116, 118. The arc tube 204 of the CMH lamp 202 is more of a point source than an incandescent lamp 104 allowing a more precise focus than an incandescent lamp 104.

The CMH lamp 202 is more energy efficient and also produces much less heat than an incandescent lamp 104. The CMH lamp 202 typically has a greater lamp life than an incandescent lamp 104. Reduced heat output of a CMH lamp 202 is advantageous for several reasons. First, a CMH base 208 can be fitted close to the framing projector body 102 so that less light leaks from the framing projector 200. The CMH lamp 202 can be positioned vertical, horizontal, or inverted. Less infrared light is also generated and directed at an intended target. This is advantageous because less emitted infrared light is less damaging to sensitive art work, such as a painting.

Less emitted infrared light and the universal positioning of the CMH lamp 202 are also advantageous because these features allow a mirror element to be placed at the opening of the focal tube assembly 125 of the framing projector body 102. A mirror can then reflect light to a target. This allows the framing projector 200 to be positioned vertically within a framing projector housing so that light is directed down. The light is then reflected off of the mirror to the target at approximately 90 degrees. This setup with a mirror allows a less obtrusive opening in a framing projector housing and less of the framing projector focal tube assembly 125 is exposed.

The reduced heat output of a CMH lamp 202 is also advantageous because the framing projector body 102, CMH base 208, framing projector housing, etc., do not get as hot as with an incandescent lamp 104. This is very advantageous because the framing projector 200 in a framing projector housing forming a light fixture may be IC rated and airtight rated. In addition, positioning the framing projector 200 within the housing is easier because the various parts do not get as hot to the touch.

A CMH lamp 202 is also less affected by positioning away from the vertical axis 118. An incandescent filament 106 can sag and break when positioned other than vertical and the filament 106 is heated. The arc tube 204 of a CMH lamp 202 may operate stably in positions other than vertical. A CMH lamp 202 also has a high CRI so that it is appropriate for framing artwork. One of skill in the art will recognize other advantages of a CMH lamp 202 in a framing projector 200. One example of a CMH lamp 202 is a General Electric® ConstantColor CMH™.

The CMH lamp 202 plugs into a CMH socket 206 that is attached to a CMH base 208. The CMH socket 206 is configured to mate with and to support the CMH lamp 202. The CMH socket 206 provides electrical connection to the CMH lamp 202 and typically includes wire leads or other conductors that may be connected to a CMH ballast. In one embodiment, the wire leads connect to a connector on the CMH socket 206 or CMH base 208. In another embodiment, wire leads include a connector that mates with another connector attached to wiring extended from the CMH ballast. In yet another embodiment, wiring directly connects the CMH socket 206 to the CMH ballast without intervening connectors. One of skill in the art will recognize other ways to connect a CMH socket 206 to a CMH ballast.

The CMH socket 206, in one embodiment, includes an electrical connection on the side of the CMH socket 206 where the CMH lamp 202 plugs into the top of the CMH socket 206. The wiring may then extend out of the side of the CMH base 208. This is advantageous because a metallic conduit elbow 126 is not required at the bottom of the CMH base 208, as is the case for the incandescent lamp base 110. In addition, because of the reduced heat output of the CMH lamp 202, the wiring may be covered by a non-metallic sheath rather than flexible metal conduit 128 allowing additional flexibility in the installation. The wiring covered by a non-metallic sheath is typically more flexible than flexible metal conduit 128. Wiring to the side of CMH socket 206 and CMH base 208 is advantageous because it allows the framing projector 200 to be mounted at a steeper angle within the framing projector housing, thus allowing the framing projector 200 to focus light higher on a wall when the framing projector housing is in a ceiling.

The wiring, in one embodiment, extends out of the bottom of the CMH socket 206. The wiring may then extend out of the bottom or the side of the CMH base 208. For example, the CMH socket 206 may be mounted with spacers, legs, etc. to provide a gap between the CMH base 208 and the CMH socket 206 to accommodate wiring. In another example, the CMH socket 206 includes a channel for wiring to extend from the bottom of the CMH socket 206 out to a side of the CMH socket 206. One of skill in the art will recognize other ways that wiring may extend out of a CMH socket 206 and a CMH base 208.

The CMH base 208 is connected to the CMH socket 206 and attached to the framing projector body 102 using fasteners 210. The CMH base 208 is specifically designed to match fasteners 112 of the incandescent lamp base 110 and to position the CMH lamp 202 so that the center of the arc tube 204 is at the intersection of the horizontal and vertical axes 116, 118. For example, the incandescent lamp base 110 may include a specific pattern of three fasteners 112. The CMH base 208 would also include three fasteners 210 mounted in an identical pattern to that of the incandescent lamp base 110 so that the CMH base 208 with a CMH socket 206 and CMH lamp 202 can replace an incandescent lamp base 110 with socket 108 and lamp 104.

In one embodiment, the CMH base 208 includes spacers or other means to appropriately position the CMH socket and lamp 206, 202 without any further adjustment. In another embodiment, the CMH base 208 and fasteners 210 are adjustable to allow the position of the CMH socket and lamp 206, 202 to be adjusted so the horizontal and vertical axes intersection 116, 118 matches the center of the arc tube 204 of the CMH lamp 202.

The fasteners 210, in one example, may be round-head or pan-head screw that may be screwed into the framing projector body 102. The fasteners 210 may include a retaining washer holding a spring in place that is positioned around the screw and held with tension by the washer and screw head. The CMH base 208 may include three holes with slots where the holes are just larger than the screw heads and the slots are smaller than the screw head. The CMH base 208 may then be connected to the framing projector body 102 by roughly positioning the base 208 so that the CMH lamp 202 is into the framing projector body 102.

The CMH base 208 is then positioned so the three holes are over three fasteners 210. The CMH base 208 is then pushed so the screw heads of the fasteners 210 extend through the holes in the CMH base 208 and then rotated so the screw threads are in the slots extending from the three holes in the CMH base 208. The springs then push on the washers and the washers push against the CMH base 208 to provide tension to hold the CMH base 208 in position. The screws of the fasteners 210 may then be turned in or out to adjust the position of the CMH lamp 202.

In other embodiments, the fasteners 210 include bolts, pins, connectors or any other means to connect the CMH base 208 to a framing projector body 102 configured for an incandescent lamp base 110. In another embodiment, the framing projector body 102 includes fasteners 112 used to attach an incandescent lamp base 110, and the CMH base 208 is attached to the framing projector body 102 using the fasteners 112 used to attach the incandescent lamp base 110. One of skill in the art will recognize other ways to attach a CMH base 208 to a framing projector body 102 configured for an incandescent lamp base 110 and to adjust the CMH base 208 as required.

The CMH base 208, in one embodiment, mates to the framing projector body 102 closer than an incandescent lamp base 110. Typically, the incandescent lamp base 110 includes a gap to allow air circulation. However, the gap also allows light to escape from the framing projector 100. Due to the reduced heat load of the CMH lamp 202, the CMH base 208 can fit closer to the framing projector body 102 so less light leaks from any gap between the CMH base 208 and the framing projector body 102.

Figure 3:
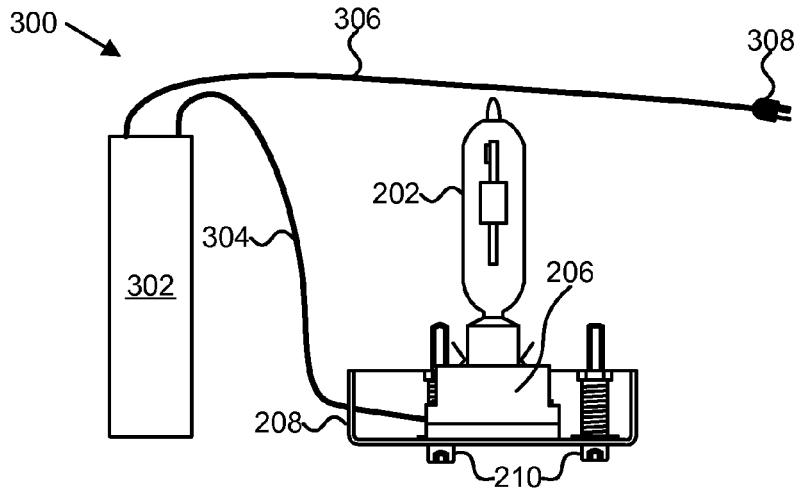
FIG. 3 is a schematic block diagram illustrating one embodiment of an apparatus for a CMH retrofit kit for a framing projector in accordance with the present invention.

FIG. 3 is a schematic block diagram illustrating one embodiment of an apparatus 300 for a CMH retrofit kit for a framing projector in accordance with the present invention. The apparatus 300 includes a CMH socket 206 configured to receive a CMH lamp 202, a CMH base 208, and fasteners 210, which are substantially similar to those described in relation to the framing projector 200 in FIG. 2. The apparatus 300 also includes a CMH ballast 302, base to ballast wiring 304, ballast to connector wiring 306, and a plug 308, which are described below.

The apparatus 300 includes a CMH ballast 302. The CMH ballast 302 provides conditioning of electrical power sufficient to start and operate the CMH lamp 202. Typically, HID lamps, florescent lamps, etc. require a ballast to excite gasses within a connected lamp. The CMH ballast 302 is configured to provide the appropriate electrical voltage, frequency, signals, etc. for a particular CMH lamp 202. For example, if a 150 W CMH lamp 202 is provided, the CMH ballast 302 is sized and configured appropriately for the 150 W CMH lamp 202. The CMH ballast 302, in one embodiment, is an electronic ballast. In another embodiment, the CMH ballast 302 is a magnetic ballast. Electronic ballasts are preferred in quiet environments because electronic ballasts are typically quieter than magnetic ballasts.

The CMH ballast 302, in one embodiment, is configured to connect to an appropriate building power source. For example, the CMH ballast 302 may connect to a power source used to previously connect a framing projector 100 with an incandescent lamp 104. The power source may be a 120 volt ("V") alternating current ("AC") source with a 15 ampere ("A") or a 20 A breaker. In another embodiment, the CMH ballast 302 is capable of accepting a wide range of input voltages and frequencies. For example, the CMH ballast 302 may be a multi-tap ballast or an electronic ballast with a variable input.

In one embodiment, the CMH ballast 302 is a dimming ballast. The dimming CMH ballast 302, in one embodiment, includes a connection for control wiring to a dimmer switch. In another embodiment, the CMH ballast 302 is responsive to a switch inline with the input power to the CMH ballast 302. In another embodiment, the dimmable CMH ballast 302 is responsive to a wireless control. One of skill in the art will recognize other ways that a dimmable CMH ballast 302 may be controlled.

The apparatus 300 includes base to ballast wiring 304 configured to carry electrical power and/or a control signal, such as a starting signal, to the CMH lamp 202 through the CMH socket 206. The base to ballast wiring 304, in one embodiment, is covered with a non-metallic sheath. The non-metallic sheath may be a heat-resistant tubing, a heat-shrink tubing, etc. that is rated for temperatures generated within a fixture containing a framing projector 200 with a CMH lamp 202. The base to ballast wiring 304 may include a connector as described above in relation to the framing projector 200 depicted in FIG. 2. The connector may be plastic or other suitable material, and in one embodiment, may be a quick-connect Molex® connector. In one embodiment, the CMH ballast 302 and/or the CMH socket 206 include a connector and the base to ballast wiring 304 includes matching connector(s).

The apparatus 300, in one embodiment, includes ballast to connector wiring 306. The ballast to connector wiring 306, in one embodiment, is flexible wiring with a covering. The ballast to connector wiring 306, in one embodiment, comprises individual multi-strand wires bundled inside a fiberglass sheath. In another embodiment, the ballast to connector wiring 306 comprises flexible SO cord (as designated in the National Electrical Code®.) In one embodiment, the ballast to connector wiring 306 is connected directly to a power source, such as by wire nuts within a junction box. In another embodiment, the ballast to connector wiring 306 includes a connector that plugs to a matching connector. For example, the connector may be a quick-connect Molex connector. In another example, the connector may be a plug 308, such as a three prong, 15 A electrical plug that plugs into a 15 A or 20 A receptacle. In yet another example, the apparatus 300 does not include a plug 308 and the ballast to the connector wiring 306 is hard-wired to building power. One of skill in the art will recognize other ways that ballast to connector wiring 306 may be connected to a power source.

Figure 4:
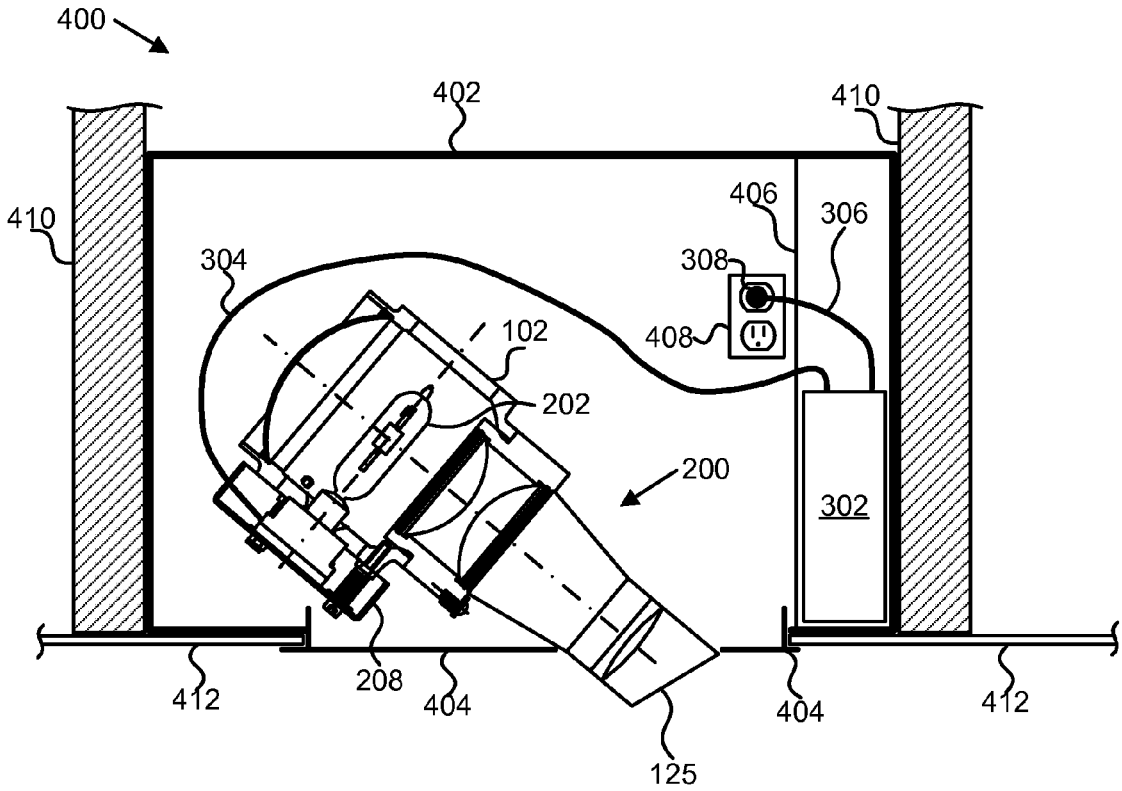
FIG. 4 is a schematic block diagram illustrating one embodiment of a system for a CMH retrofit kit for a framing projector in accordance with the present invention.

FIG. 4 is a schematic block diagram illustrating one embodiment of a system 400 for a CMH retrofit kit for a framing projector in accordance with the present invention. The system 400 includes a framing projector 200 with a framing projector body 102 with a CMH lamp 202, a CMH ballast 302, base to ballast wiring 304, ballast to connector wiring 306, and a plug 308 that are substantially similar to those described above in relation to the framing projector 200 depicted in FIG. 2 and apparatus 300 depicted in FIG. 3. The system 400 also includes a framing projector housing 402, a cover plate 404, a ballast cover 406, and a receptacle 408, which are described below. The system 400 is also depicted as mounted in a ceiling with joists 410 and sheetrock 412.

The system 400 includes framing projector housing 402 configured to house the framing projector 200, the CMH ballast 302, ballast cover 406, wiring 304, 306, and plug 308. Typically, the framing projector housing 402 is a metal box sized to fit between ceiling joists 410 or studs in a wall. The framing projector housing 402 may be made of any appropriate material. The framing projector housing 402 includes an opening though which the framing projector 200 projects light. When concealed in a wall or ceiling, typically the framing projector housing 402 is concealed behind sheetrock 412 except for an opening in the sheetrock 412 that matches the projector opening in the framing projector housing 402. Typically the opening is round and is covered with a cover plate 404. The cover plate 404 includes a small opening sized for the focal tube assembly 125 of the framing projector 200 after the framing projector 200 is positioned to project light onto a target. Often the opening in the cover plate 404 is custom made for the application.

The framing projector housing 402 also includes mounting hardware (not shown) to mount the framing projector 200 in a precise position. Traditionally, a framing projector 200 is positioned using a rod and gimbals. The framing projector 200 may be held in position by any means that allows the framing projector 200 to be precisely mounted to project light onto a target. The framing projector housing 402 may also include vent holes for heat dissipation. In one embodiment, a framing projector housing 402 with vent holes for an incandescent framing projector 100 is modified so that the vent holes are plugged when a CMH lamp 202, socket 206, and base 208 replace the incandescent lamp assembly 104, 108, 110. Plugging the vent holes may allow the fixture to be IC rated or airtight rated.

The framing projector housing 402 includes a CMH ballast 302 with a ballast cover 406 over the CMH ballast 302. The CMH ballast 302 is positioned in the framing projector housing 402 to avoid possible positioning locations of the framing projector 200. In addition, the CMH ballast 302 is positioned as far away as practical from the framing projector 200 to minimize heat absorption from the framing projector 200. For example, the CMH ballast 302 may be positioned in a corner of the framing projector housing 402 that is furthest from the framing projector 200 positioned to project light onto a target.

The framing projector housing 402, in one embodiment, includes a ballast cover 406 that covers the CMH ballast 302. In one embodiment, the ballast cover 406 creates a wiring compartment at one end of the CMH ballast 302 for wiring 304, 306 that extends from the CMH ballast 302. The ballast cover 406 may be attached to the framing projector housing 402 with screws, bolts and nuts, pop-rivets, tabs and slots, etc. In another embodiment, the ballast cover 406 is attached to the CMH ballast 302. In yet another embodiment, the CMH ballast 302 is attached to the ballast cover 406 and the ballast cover 406 is attached to the framing projector housing 402. The ballast cover 406 may be metal, plastic, fiberglass, or any other suitable material. One of skill in the art will recognize other forms of a ballast cover 406 and means to attach the ballast cover 406.

In one embodiment, the system 400 includes a receptacle 408. The receptacle 408, in one embodiment, is mounted inside the framing projector housing 402. In another embodiment, the receptacle 408 is mounted outside the framing projector housing 402 either on the framing projector housing 402 or nearby. The receptacle 408 is wired to a power source, such as building power. The building power may also be controlled by a lighting controller, such as a light switch, computer controlled relay, etc. In one embodiment, the receptacle 408 is installed when the framing projector housing 402 with a framing projector 100 with an incandescent lamp 104 is installed. When the apparatus 300 is installed as a CMH retrofit kit, the incandescent lamp 104, socket 108, and base 110 are removed and a plug wired to the incandescent lamp socket 108 is unplugged from the receptacle 408. The plug 308 attached to the ballast to connector wiring 306 is then plugged into the receptacle 408 when the CMH retrofit kit apparatus 300 is installed.

In other examples, other connections are made between the ballast to connector wiring 306 and building power. For example, a quick-connect Molex connector may be used. In another example, the ballast to connector wiring 306 is connected to building power using wire nuts inside a junction box. One of skill in the art will recognize other ways that the CMH ballast 302 may be connected to building power.

Figure 5:
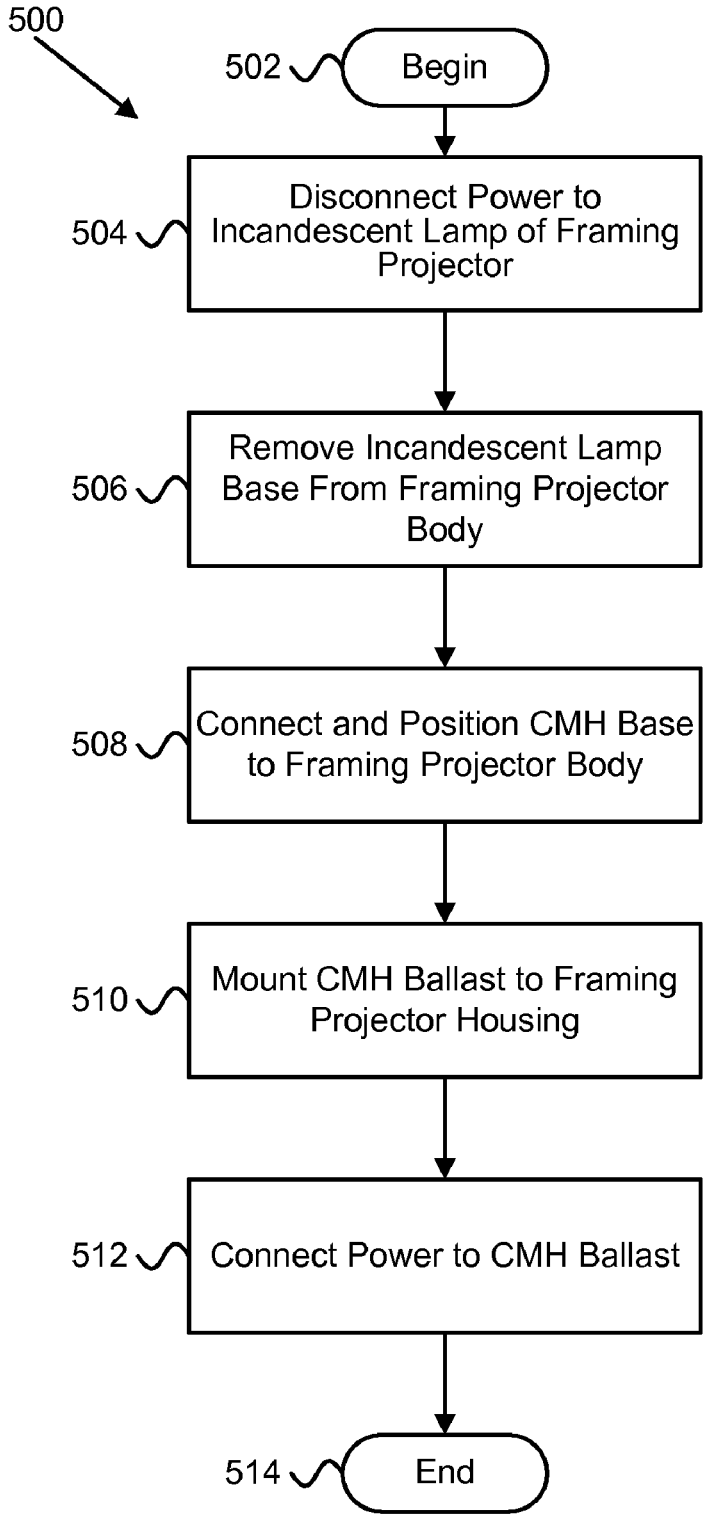
FIG. 5 is a schematic flow chart diagram illustrating one embodiment of a method for installing a CMH retrofit kit in a framing projector with an incandescent lamp in accordance with the present invention.

FIG. 5 is a schematic flow chart diagram illustrating one embodiment of a method 500 for installing a CMH retrofit kit in a framing projector with an incandescent lamp in accordance with the present invention. The method 500 begins 502 and power is disconnected 504 from an incandescent lamp 104 of a framing projector 100. The framing projector 100 includes a framing projector body 102, and an incandescent lamp 104, an incandescent lamp socket 108, and an incandescent lamp base 110 attached to the framing projector body 102 with fasteners 112.

The incandescent lamp base 110 is removed 506 from the framing projector body 102. The incandescent lamp socket 108 and incandescent lamp 104 are typically attached to the incandescent lamp base 110 so removal of the incandescent lamp base 110 also removes the incandescent lamp and socket 104, 108. In one embodiment, the framing projector 100 is removed from a framing projector housing 402 prior to removal 506 of the incandescent lamp base 110. In another embodiment, the framing projector body 102 remains attached to a framing projector housing 402 while the incandescent lamp base 110 is removed 506.

The CMH base 208 is connected 508 to and positioned in the framing projector body 102. The CMH base 208 is attached to a CMH socket 206 and a CMH lamp 202 is plugged into the CMH socket 206. In one example, positioning of the CMH lamp 202 in the CMH base 208 is accomplished prior to connection 508 of the CMH base 208 to the framing projector body 102 by design.

In another embodiment, the CMH base 208 is connected 508 to the framing projector body 102 and then the CMH base 208 is positioned using fasteners 210 supplied with the retrofit apparatus 300 or existing fasteners 112. Positioning of the CMH base 208 moves the CMH lamp 202 into position so the arc tube 204 of the CMH lamp 202 is at the horizontal and vertical axes intersection 116, 118 of the framing projector body 102, which is at the point where the center of the filament 106 of an incandescent lamp 104 is designed to be centered for the framing projector 102.

In one embodiment, a jig is used to adjust the CMH base, socket, and lamp 208, 206, 202. For example, the CMH socket 206 may be connected to the CMH base 208 using an adjustable connection. A jig may be used to position the CMH lamp and socket 202, 206 relative to the CMH base 208. The CMH base is then connected 508 to the framing projector body 102. In another embodiment, a jig is used with the CMH base 208 and attached CMH socket and lamp 206, 202 to adjust the CMH base 208 position. One of skill in the art will recognize other ways to use a jig to position a CMH lamp 202 by positioning a CMH socket 206 and/or a CMH base 208.

The CMH ballast 302 is mounted 510 to the framing projector housing 402. Typically, the CMH ballast 302 is mounted in a location out of the way of the framing projector 200 and as far away as practical from the framing projector 200. Power is connected 512 to the CMH ballast 302, and the method 500 ends 514. Power may be connected 512 by connecting ballast to connector wiring 306 to building power.

Figure 6:
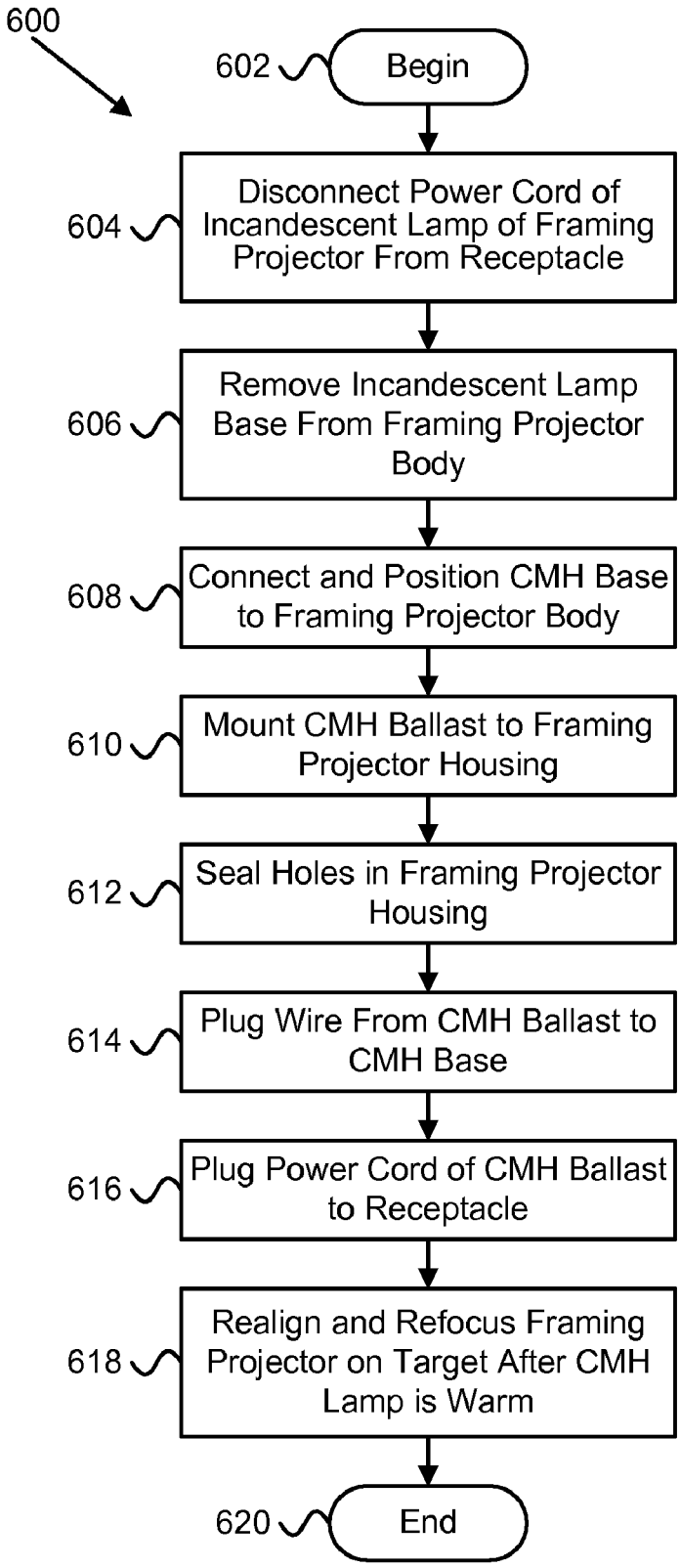
FIG. 6 is a schematic flow chart diagram illustrating another embodiment of a method for installing a CMH retrofit kit in a framing projector with an incandescent lamp in accordance with the present invention.

FIG. 6 is a schematic flow chart diagram illustrating another embodiment of a method 600 for installing a CMH retrofit kit in a framing projector with an incandescent lamp in accordance with the present invention. The method 600 begins 602 and a power cord (not shown) with an attached plug (not shown) is disconnected 604 from a receptacle 408 that is connected to building power. In one embodiment, the building power is 120 V AC and the receptacle is a 15 A or 20 A receptacle.

The framing projector 100 includes a framing projector body 102, and an incandescent lamp 104, an incandescent lamp socket 108, and an incandescent lamp base 110 attached to the framing projector body 102 with fasteners 112. The incandescent lamp base 110 is removed 606 from the framing projector body 102. The incandescent lamp socket 108 and incandescent lamp 104 are typically attached to the incandescent lamp base 110 so removal 606 of the incandescent lamp base 110 also removes the incandescent lamp and socket 104, 108.

The CMH base 208 is connected 608 to and positioned in the framing projector body 102. Connecting 608 and positioning the CMH base 208 is substantially similar to connecting 508 and positioning the CMH base 208 described above in relation to the method 500 of FIG. 5. The CMH ballast 302 is mounted 610 to the framing projector housing 402. Optionally, holes in the framing projector housing 402, such as vent holes, are sealed 612.

The base to ballast wiring 304 is plugged 614 using Molex or similar connectors to make electrical connection between wire leads on the CMH socket 206 and the CMH ballast 302. The base to ballast wiring 304 may include a connector at one end or both ends. The plug 308 attached to the ballast to connector wiring 306 is plugged 616 to the receptacle 408. The framing projector 200 is realigned 618 and refocused as necessary on the intended target after the CMH lamp 202 is warm and the method 600 ends 620.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus to replace an incandescent lamp with a ceramic metal halide ("CMH") lamp in a framing projector, the apparatus comprising:

a CMH base that connects to a framing projector body at a connection for an incandescent lamp base for an incandescent lamp, the CMH base positioning a CMH lamp relative to a focal point of a reflector within the framing projector body, the CMH lamp plugged into a CMH socket on the CMH base, the framing projector body comprising an opening and connection for an incandescent base holding an incandescent lamp relative to the focal point; and a CMH ballast for the CMH lamp, the CMH ballast connected to the CMH socket and that connects to an electrical connection of the incandescent lamp base.

2. The apparatus of claim 1, further comprising a framing projector housing, wherein the framing projector body and CMH ballast are mounted within the framing projector housing.

3. The apparatus of claim 2, wherein the CMH ballast is mounted in the framing projector housing in a position that does not interfere with possible positions of the framing projector body and an attached positioning mechanism.

4. The apparatus of claim 1, wherein the CMH base is attached to the framing projector body with adjustable fasteners for positioning the CMH lamp relative to the focal point.

5. The apparatus of claim 1, wherein the CMH base positions the center of an arc tube in the CMH lamp at a location designed for mounting the center of a filament of the incandescent lamp.

6. The apparatus of claim 1, wherein the CMH base comprises light shielding to prevent light leakage allowed by the incandescent base.

7. The apparatus of claim 1, wherein wiring connecting the CMH ballast to the CMH base comprises a non-metallic, thermo protective covering over insulation of the wiring.

8. The apparatus of claim 1, wherein wiring connecting the CMH ballast to the CMH base comprises a connection through a side of the CMH base, wherein the CMH lamp plugs into the top of the CMH socket mounted on top of the CMH base.

9. The apparatus of claim 1, wherein the CMH ballast comprises a dimmable ballast.

10. The apparatus of claim 1, wherein the electrical connection of the framing projector housing comprises an electrical outlet.

11. A system to replace an incandescent lamp with a ceramic metal halide ("CMH") lamp in a framing projector, the system comprising:

a framing projector housing comprising a framing projector body and an electrical connection, the framing projector body comprising a connection for an incandescent base configured to hold an incandescent lamp;

a CMH lamp;

a CMH base with a socket holding the CMH lamp and connected to the framing projector body at the connection for the incandescent lamp base, the CMH base configured to position the CMH lamp plugged into the socket of the CMH base at a location designed for mounting the center of a filament of the incandescent lamp relative to a focal point of a reflector within the framing projector housing; and a CMH ballast mounted in the framing projector housing and connected to the CMH base and that connects to the electrical connection.

12. The system of claim 11, wherein the framing projector housing is located in one of a ceiling and a wall.

13. The system of claim 11, wherein the framing projector housing containing the CMH lamp, the CMH base, and the CMH ballast comprise a fixture with one of an insulation contact ("IC") rating and an air tight rating.

14. The system of claim 11, further comprising a ballast cover mountable over the CMH ballast.

15. A method for replacing an incandescent lamp with a ceramic metal halide ("CMH") lamp in a framing projector, the method comprising:

disconnecting power to an incandescent lamp of a framing projector body, the incandescent lamp plugged into an incandescent lamp base, the incandescent base and lamp mounted to the framing projector body, the framing projector body positioned within a framing projector housing;

removing the incandescent lamp base from the framing projector body;

connecting and positioning a CMH base to the framing projector body, wherein a CMH lamp is plugged into a socket mounted on the CMH base;

mounting a CMH ballast to the framing projector housing, the CMH ballast wired to the CMH base; and connecting power to the CMH ballast to a power source that was disconnected from the incandescent lamp.

16. The method of claim 15, wherein positioning the CMH base further comprises positioning the CMH lamp plugged into the socket of the CMH base at a location designed for mounting the center of a filament of the incandescent lamp relative to a focal point of a reflector within the framing projector housing.

17. The method of claim 16, wherein positioning the CMH base further comprises positioning the CMH base so that approximately the center of a lighting illumination point within the CMH lamp aligns with a location designed for mounting the center of a filament of the incandescent lamp relative to the focal point.

18. The method of claim 15, wherein disconnecting power to the incandescent lamp further comprises unplugging a power cord from an electrical outlet mounted at the framing projector housing, and wherein connecting power to the CMH ballast further comprises plugging a cord extending from the CMH ballast into an electrical outlet mounted at the framing projector housing.

19. The method of claim 15, flirt her comprising realigning and refocusing the framing projector on an intended target in response to power being applied to the CMH lamp and the CMH lamp warming to a nominal operating temperature.

20. The method of claim 15, further comprising sealing holes in the framing projector housing.

* * * * *